US011339574B2

(12) United States Patent
You

(10) Patent No.: US 11,339,574 B2
(45) Date of Patent: May 24, 2022

(54) HANDRAIL

(71) Applicant: Youshi (Xiamen) Sanitary Ware Industrial Co., Ltd., Xiamen (CN)

(72) Inventor: Zhangsen You, Xiamen (CN)

(73) Assignee: Youshi (Xiamen) Sanitary Ware Industrial Co., Ltd., Xiamen (CN)

( * ) Notice: Subject to any disclaimer, the term of this patent is extended or adjusted under 35 U.S.C. 154(b) by 126 days.

(21) Appl. No.: 16/854,938

(22) Filed: Apr. 22, 2020

(65) Prior Publication Data

US 2021/0277662 A1 Sep. 9, 2021

(30) Foreign Application Priority Data

Mar. 5, 2020 (CN) ..... 202020262293.1

(51) Int. Cl.
*E04F 11/18* (2006.01)

(52) U.S. Cl.
CPC ... *E04F 11/1804* (2013.01); *E04F 2011/1868* (2013.01)

(58) Field of Classification Search
CPC ..... E04F 11/1802; E04F 11/1804; E04F 11/1808; E04F 11/1812; E04F 11/1814; E04F 2011/1868; E04H 17/1488; A47K 3/003; A47K 17/022; A47K 2201/00; A47K 2201/02; F16B 2200/20; F16B 9/07; F16B 9/09
See application file for complete search history.

(56) References Cited

U.S. PATENT DOCUMENTS

| | | | | | |
|---|---|---|---|---|---|
| 2,129,999 | A * | 9/1938 | Ewing | E04F 11/1812 | 403/187 |
| 5,799,804 | A * | 9/1998 | Sharpe | A47K 10/04 | 211/105.1 |
| 6,336,620 | B1 * | 1/2002 | Belli | E04F 11/1814 | 248/519 |
| 2002/0104946 | A1 * | 8/2002 | Lai | A47K 10/04 | 248/316.8 |
| 2009/0016815 | A1 * | 1/2009 | Moore | E04F 11/1804 | 403/300 |

FOREIGN PATENT DOCUMENTS

| | | | | |
|---|---|---|---|---|
| CA | 1049997 A * | 3/1979 | ..... | A47K 3/003 |
| DE | 3132855 A1 * | 3/1983 | ..... | E04F 11/1804 |
| DE | 20001896 U1 * | 5/2000 | ..... | E04F 11/1804 |

(Continued)

*Primary Examiner* — Jonathan P Masinick
(74) *Attorney, Agent, or Firm* — Bayramoglu Law Offices LLC

(57) ABSTRACT

A handrail, comprising a handrail body and a mounting plate, wherein at least one end of the handrail body is provided with a fixture block, and the fixture block and the end face of the said handrail body jointly form a notch; the mounting plate is preferred to be fixed on a wall, the mounting plate has an outer side face facing the handrail body and an inner side face facing the wall, a boss is arranged on the mounting plate protruding from the inner side face toward the outer side face, and a slot penetrating through the inner side face and the outer side face is arranged on the boss, the fixture block is inserted into the slot and bent to form a first bending part, and the first bending part is firmly pressed against the inner side face of the boss.

9 Claims, 6 Drawing Sheets

(56) References Cited

FOREIGN PATENT DOCUMENTS

| | | | | | |
|---|---|---|---|---|---|
| DE | 19945966 | A1 | * | 3/2001 | ..... E04F 11/1804 |
| DE | 10101782 | A1 | * | 10/2001 | ..... E04F 11/1804 |
| GB | 212496 | A | * | 3/1924 | ..... E04F 11/1804 |
| KR | 20020082723 | A | * | 10/2002 | |
| KR | 20070000080 | U | * | 1/2007 | |
| KR | 20070000086 | U | * | 1/2007 | |
| KR | 100966268 | B1 | * | 6/2010 | |
| KR | 101128035 | B1 | * | 3/2012 | |
| WO | WO-2007062463 | A1 | * | 6/2007 | ..... E04F 11/1804 |

* cited by examiner

HANDRAIL

CROSS-REFERENCE TO RELATED APPLICATIONS

This application is based on and claims priority to Chinese Patent Application No. 202020262293.1, filed on Mar. 5, 2020, the entire contents of which are incorporated herein by reference.

TECHNICAL FIELD

The present invention relates to a handrail.

BACKGROUND

Safety handrails are mainly intended to be held by the old and the disabled, so as to prevent the old and the disabled from falling.

In the related technologies, the main body of the safety handrail and the mounting plate are connected without welding, which improves the production efficiency of the handrail. However, due to the structure lathing process is needed to form a limiting groove on the handrail body, and the connection between the handrail body and the mounting plate may easily loose, resulting in displacement. This may cause unreliable installation of the handrail body.

SUMMARY

The present invention aims to solve one of the technical problems in the said technology at least to a certain extent. Therefore, one of the purposes of the present invention is to propose a handrail.

In order to achieve the above purpose, the present invention provides a handrail on one hand, which comprises:

A handrail body, wherein at least one end of the handrail body is provided with a fixture block, and the fixture block and the end face of the said handrail body jointly form a notch;

A mounting plate, wherein the mounting plate is preferred to be fixed on a wall, the mounting plate has an outer side face facing the handrail body and an inner side face facing the wall, a boss is arranged on the mounting plate protruding from the inner side face toward the outer side face, and a slot penetrating through the inner side face and the outer side face is arranged on the boss, the fixture block is inserted into the slot and bent to form a first bending part, the first bending portion is firmly pressed against the inner side face of the boss, and the notch is connected to the outer side face.

According to the handrail of the present invention, the mounting plate and the handrail body are connected by press fitting, and fixing by welding is not needed; the handrail is fitted with the slot on the mounting plate through the fixture block of the handrail body, so that the handrail body can be firmly connected with the mounting plate to avoid loosening of the handrail body. The structure also avoids making a limiting groove on the handrail body, simplifies the processing procedures of the handrail, and improves processing efficiency of the handrail.

Further, according to a handrail set forth in the above embodiment of the present invention, the handrail may also have the following additional technical features:

According to an embodiment of the present invention, there are a plurality of fixture blocks, a plurality of fixture blocks are arranged on the end face of the handrail body with circumferential interval, and a notch is formed jointly by the two adjacent fixture blocks and the end face of the said handrail body.

According to an embodiment of the present invention, there are a plurality of slots, each of the slots are provided with a fixture block, and a notch is formed by the outer side face between the two adjacent slots.

According to an embodiment of the present invention, a mounting hole is arranged on the mounting plate penetrating through the inner side face and the outer side face, and the mounting hole is used to fixing the mounting plate on the wall through bolts.

According to an embodiment of the present invention, the handrail also comprises a decorative cover, the decorative cover is arranged on the handrail body and buckled with the mounting plate.

According to an embodiment of the present invention, a bulge is arranged on the inner side wall of the decorative cover, card slots are arranged at the edge of the mounting plate, the bulge is buckled in the card slot so that the decorative cover can be connected with the mounting plate.

According to an embodiment of the present invention, the bulge is formed when the outer side wall of the decorative cover is raised towards the inner side wall; the said slots are formed when the inner side face of the mounting plate is raised towards the outer side face.

According to an embodiment of the present invention, there are a plurality of slots, and the slots are arranged along the mounting plate with circumferential interval; there are a plurality of bulges, and the bulges are buckled in the slots one by one correspondingly.

According to an embodiment of the present invention, the first bending part bends towards the edges of the boss or/and the center of the boss.

According to an embodiment of the present invention, the handrail body comprises two second bending parts and a straight rod part, a first end of the two second bending parts are connected to the two ends of the straight rod one by one correspondingly, the said fixture block is arranged at a second end of both the two second bending parts; there are two mounting plates, and the two mounting plates are connected with the two second bending parts one by one correspondingly.

Additional aspects and advantages of the present invention will be partially given in the following description, and some will be clarified in the following description, or be learned through the applications of the present invention.

Figure 1:
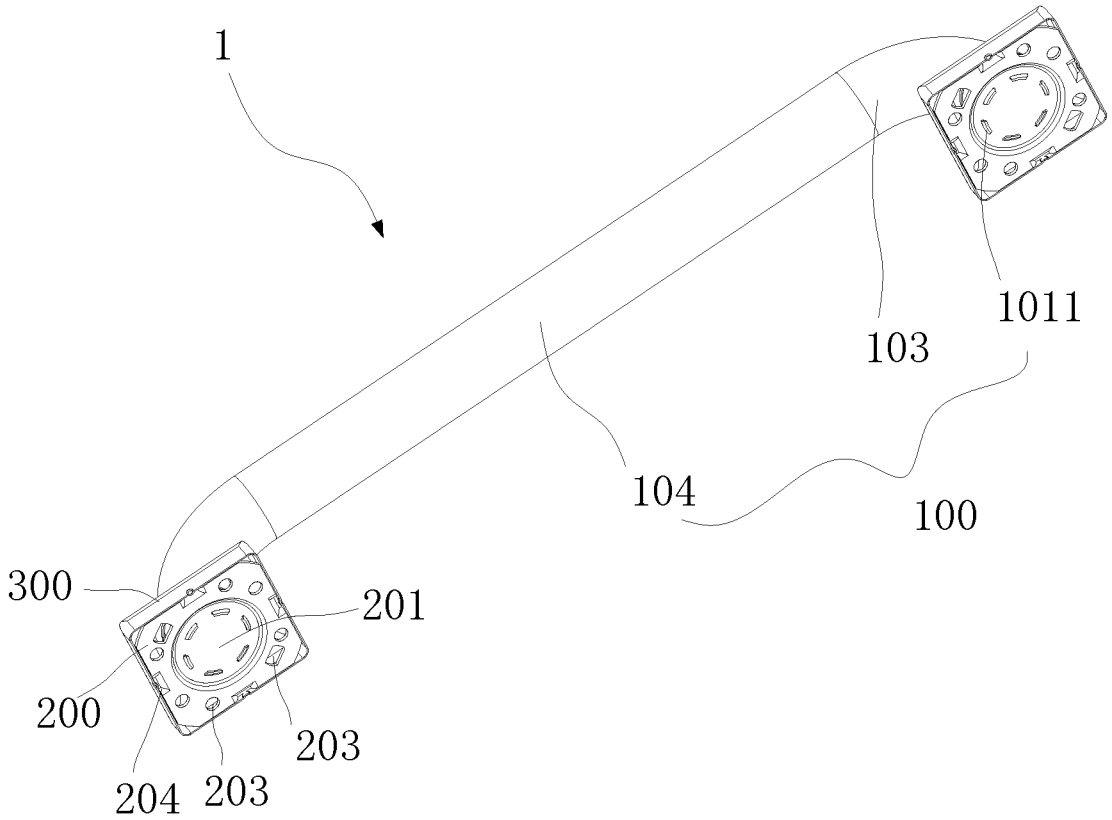
FIG. 1 depicts a structure diagram of a handrail embodiment of the present invention.

Description of symbols in the Figures: handrail 1;

Handrail body 100, fixture block 101, first bending part 1011, notch 102, second bending part 103, straight rod 104;

Mounting plate 200, boss 201, slot 202, mounting hole 203, card slot 204

Decorative cover 300, through hole 301, bulge 302

DETAILED DESCRIPTION OF THE EMBODIMENTS

The embodiments of the present invention will be elaborated below. The examples of the said embodiments are shown in the drawings, wherein the same or similar numbers indicate the same or similar elements or the elements with the same or similar functions. The embodiments described below with reference to the drawings are exemplary, and are intended to explain the present invention, but will not be construed as limiting the present invention.

In order to better understand the above technical solutions, the exemplary embodiments of the present invention will be elaborated according to the attached figures. Although the drawings show exemplary embodiments of the present invention, it should be understood that the present invention can be implemented in various embodiments and should not be limited by the embodiments mentioned herein. On the contrary, these embodiments are provided to ensure a more thorough understanding of the present invention and to fully convey the scope of the present invention to those skilled in the art.

The implementation of a handrail provided by the present invention is further described in combination with the attached FIG. 1-FIG. 9.

As shown in FIG. 1 to FIG. 9, according to the embodiment of the present invention, a handrail 1 comprises a handrail body 100 and a mounting plate 200.

At least one end of the handrail body 100 is provided with a fixture block 101, and the fixture block 101 and the end face of the said handrail body 100 jointly form a notch 102; The mounting plate 200 is preferred to be fixed on a wall, the mounting plate 200 has an outer side face facing the handrail body 100 and an inner side face facing the wall, a boss 201 is arranged on the mounting plate 200 protruding from the inner side face toward the outer side face, and a slot 202 penetrating through the inner side face and the outer side face is arranged on the boss 201, the fixture block 101 is inserted into the slot 202 and bent to form a first bending part 1011, the first bending part 1011 is firmly pressed against the inner side face of the boss 201, and the notch 102 is connected to the outer side face.

That is to say, the handrail body 100 and the mounting plate 200 are firmly fixed by inserting the fixture block 101 into the slot 202 and bending up. When being inserted into the slot 202, the fixture block 101 is pressed against the inner side face of the boss 201 through the first bending part, 1011, so as to prevent the fixture block 101 from separating from the slot 202; the outer side face of the mounting plate 200 is connected through the notch 102, which is conductive to limiting the end face of the handrail body 100, thus to prevent it from loosing. The arrangement of the boss 201 aims to form a containing cavity on the inner side face of the mounting plate 200, so as to avoid mutual interference between the first bending part 1011 and the wall.

Therefore, according to the handrail 1 of the present invention, the mounting plate 200 and the handrail body 100 are connected by press fitting, and fixing by welding is not needed; the handrail is fitted with the slot 202 on the mounting plate 200 through the fixture block 101 of the handrail body 100, so that the handrail body 100 can be firmly connected with the mounting plate 200 to avoid loosening of the handrail body 100. The structure also avoids making a limiting groove on the handrail body 100, simplifies the processing procedures of the handrail 1, and improves processing efficiency of the handrail 1.

Figure 2:
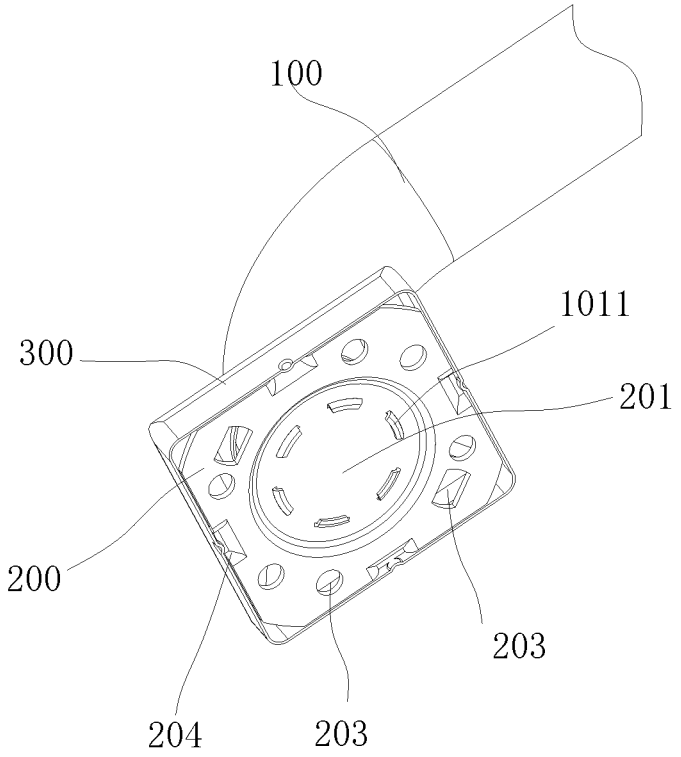
FIG. 2 depicts a local enlarged diagram of FIG. 1.

As shown in FIG. 2, according to an embodiment of the present invention, there are a plurality of fixture blocks 101, a plurality of fixture blocks 101 are arranged on the end face of the handrail body 100 with circumferential interval, and a notch 102 is formed jointly by the two adjacent fixture blocks 101 and the end face of the said handrail body 100.

Specifically, the fixture blocks 101 extend vertically outward from the end face of the handrail body 100; a plurality of fixture blocks 101 are arranged on the end face of the handrail body 100 with circumferential interval. In other words, one end of the fixture block 101 is connected to the end face of the handrail body 100; the other end is a free end, and a notch 102 is formed between two adjacent fixture blocks 101. Thus, the fixture blocks 101 are elastic fixture blocks; and firmly fixed by inserting the fixture blocks 101 arranged with circumferential interval into the slot 202 and bending up. This can further strengthen the connection between the handrail body 100 and the mounting plate 200.

Figure 4:
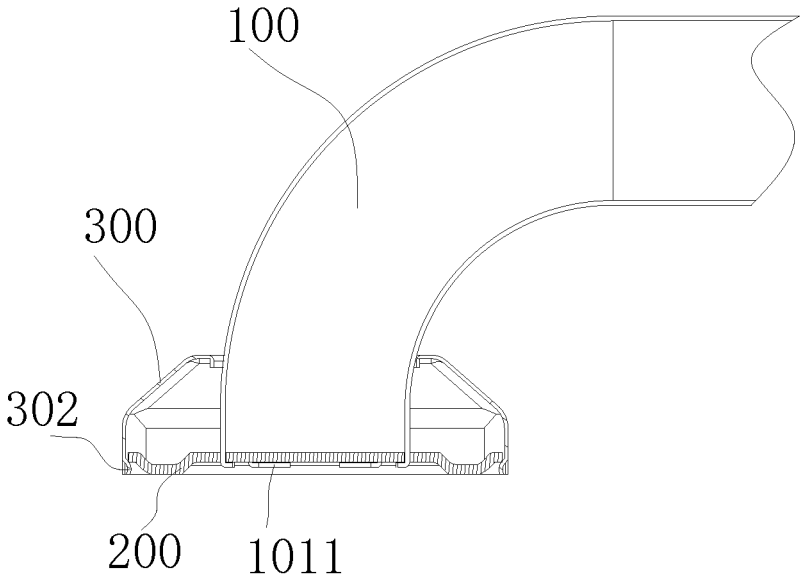
FIG. 4 depicts a local cross-sectional view of FIG. 1.
Figure 5:
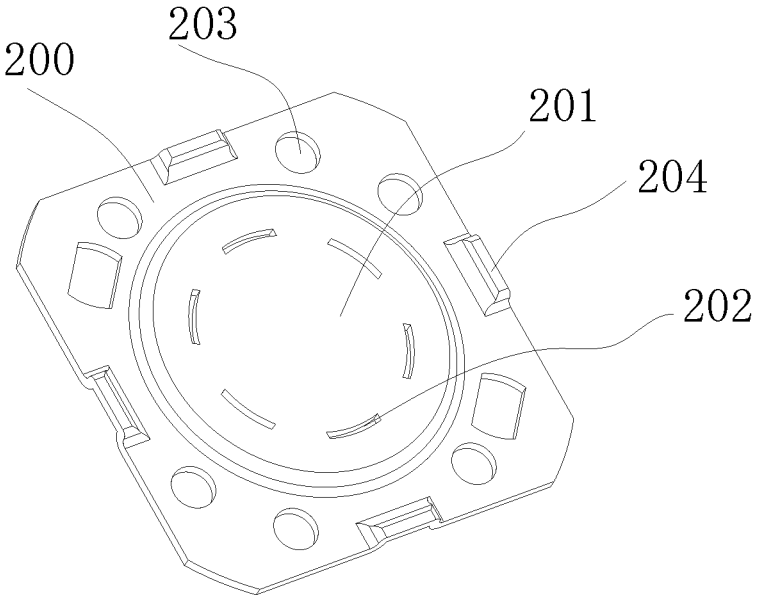
FIG. 5 depicts a structure diagram of a mounting plate according to an embodiment of the present invention.

As shown in FIG. 4, in some examples, there are a plurality of slots 202, each of the slot 202 are provided with a fixture block 101, and the outer side face between two adjacent slots 202 are pressed against the notch 102. Therefore, the quantity of fixture blocks 101 matches with that of the slots 202. Thereby, it can avoid loosing between the handrail body 100 and the mounting plate 200 due to relative rotation.

In some exemplary embodiments, a mounting hole 203 is arranged on the mounting plate 200 penetrating through the inner side face and the outer side face, and the mounting hole 203 is used to fixing the mounting plate 200 on the wall through bolts. That is to say, the mounting hole 203 can be quickly installed between the mounting plate 200 and the wall by expansion bolts.

Specifically, the mounting holes 203 are evenly distributed around the boss 201 on the mounting plate 200. Mounting holes 203 can include a plurality of round mounting holes and a plurality of strip mounting holes, wherein the strip mounting holes can be used to adjust the installation position, thus to make the installation more convenient.

According to an embodiment of the present invention, the handrail 1 also comprises a decorative cover 300, and the decorative cover 300 is arranged on the handrail body 100 and buckled with the mounting plate 200. That is to say, a through hole 301 is arranged at the middle position of the decorative cover 300, the through hole 301 enables the decorative cover 300 to be set on the handrail body 100; then, the decorative cover 300 is connected to the mounting plate 200, so that the decorative cover 300 can fully cover the mounting plate 200. Therefore, the decorative cover 300 can beautify the handrail 1, making the appearance of handrail 1 look more beautiful.

Figure 3:
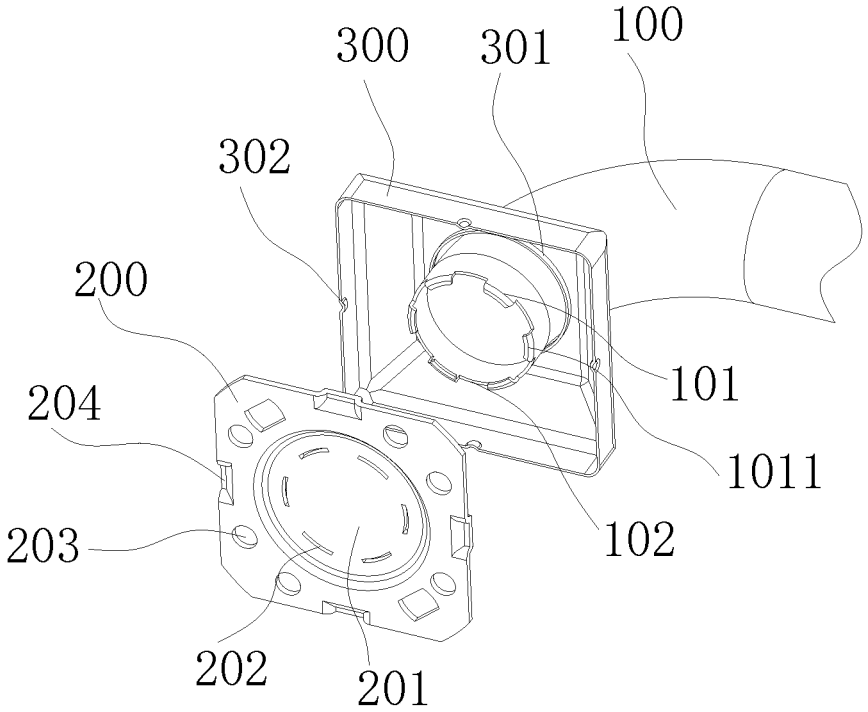
FIG. 3 depicts a local decomposition diagram of FIG. 1.

Optionally, according to FIG. 2 to FIG. 4, a bulge 302 is arranged on the inner side wall of the decorative cover 300, and a card slot 204 is arranged on the edges of the mounting plate 200, the bulge 302 is clamped in the card slot 204 so that the decorative cover 300 can be buckled with the mounting plate 200. For specific, during installation, the decorative cover 300 is pushed towards the mounting plate 200, to make the bulge 302 slide into the card slot 204 and clamped in the card slot 204.

Optionally, the bulge 302 is formed when the outer side wall of the decorative cover 300 is raised towards the inner side wall; the said card slots 204 are formed when the inner side face of the mounting plate 200 is raised towards the outer side face. Wherein, the bulge 302 is arranged at the bottom edge of the decorative cover 300; and the card slot 204 is also arranged at the edge of the mounting plate 200. Therefore, the decorative cover 300 can be connected with the mounting plate 200 by buckling them up. In addition, the structure formed by the bulge 302 and card slot 204 and the arrangement at the edges can avoid the mutual interference between the decorative cover 300 and the wall.

Optionally, there are a plurality of card slots 204, and the card slots 204 are arranged along the mounting plate 200 with circumferential interval; there are a plurality of bulges 302, and the bulges 302 are buckled in the card slots 204 one by one correspondingly. This can ensure the decorative cover 300 and the mounting plate 200 are firmly connected.

According to an embodiment of the present invention, in combination with FIG. 1, FIG. 3, FIG. 6 and FIG. 7, the first bending part 1011 bends towards the edges of the boss 201 or/and the center of the boss 201. That is to say, a plurality of first bending parts 1011 can bend towards the edges of the boss 201; and bend towards the center of the boss 201; or the first bending parts partially bend towards the edges of the boss 201, and towards the center of the boss 201. There are a number of ways for bending the fixture blocks 101.

According to an embodiment of the present invention, and as shown in FIG. 1, the handrail body 100 comprises two second bending parts 103 and a straight rod part 104, a first end of the two second bending parts 103 are connected to the two ends of the straight rod 104 one by one correspondingly, the said fixture block 101 is arranged at a second end of both the two second bending parts 103; there are two mounting plates 200, and the two mounting plates 200 are connected with the two second bending parts 103 one by one correspondingly; there are also two decorative covers 300, the two decorative covers 300 are installed on the two mounting plates 200 correspondingly.

For specific, the handrail body 100 is U-shaped, which bends at both ends of the straight rod to form two second bending parts 103. Then, the second bending parts 103 are in the same direction and in the same plane. To meet other installation requirements, the second bending parts 103 can be machined in different directions according to requirements.

Thus, according to the structure of the handrail 1 in the embodiment of the present invention, welding operation can be avoided, firm installation can be ensured, and the processing efficiency of the handrail 1 can be improved.

Embodiment I

As shown in FIG. 1, a handrail 1 comprises a handrail body 100, two mounting plates 200 and two decorative covers 300.

A plurality of fixture blocks 101 are arranged at one end of the handrail body 100, and a plurality of notches 102 are formed by the fixture blocks 101 at each end jointly with the end face of the said handrail body 100.

The mounting plate 200 is preferred to be fixed on a wall, the mounting plate 200 has an outer side face facing the handrail body 100 and an inner side face facing the wall, a boss 201 is arranged on the mounting plate 200 protruding from the inner side face toward the outer side face, and a plurality of slots 202 penetrating through the inner side face and the outer side face are arranged on the boss 201, a plurality of fixture blocks 101 are inserted into a plurality of slots 202 and bent to form a plurality of first bending parts 1011, the first bending parts 1011 are firmly pressed against the inner side face of the boss 201, and a plurality of notches 102 are pressed against the outer side face. Wherein, a plurality of the first bending parts 1011 bend towards the center of the boss 201.

The decorative cover 300 is arranged on the handrail body 100 and buckled with the mounting plate 200.

During installation, the decorative cover 300 is arranged on the handrail body 100, the fixture block 101 is inserted into the slot 202, the first bending parts 1011 bend towards the center of the boss 201, then the mounting plate 200 is fixed on the wall; finally, the decorative cover 300 is buckled on the mounting plate 200.

Embodiment II

Figure 6:
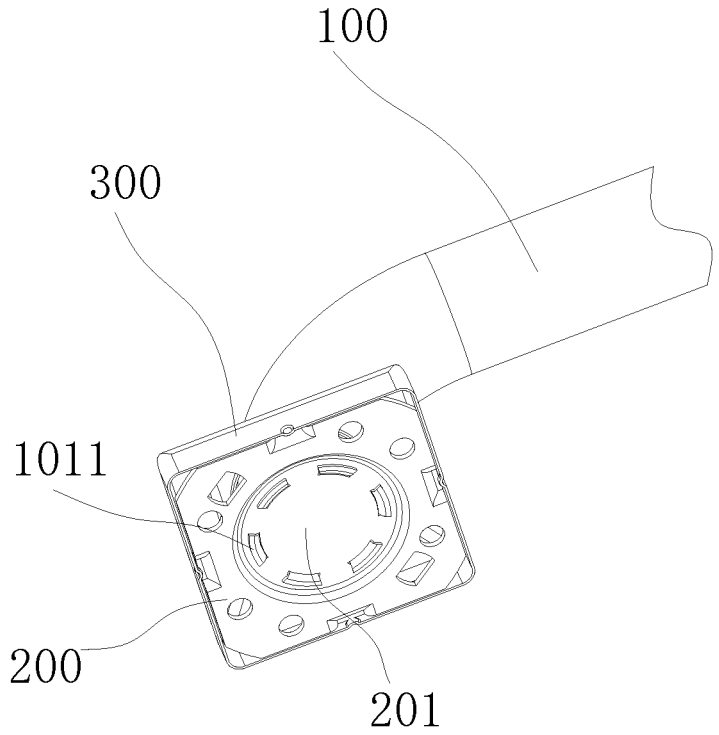
FIG. 6 depicts a schematic diagram of a handrail according to another embodiment of the present invention.
Figure 7:
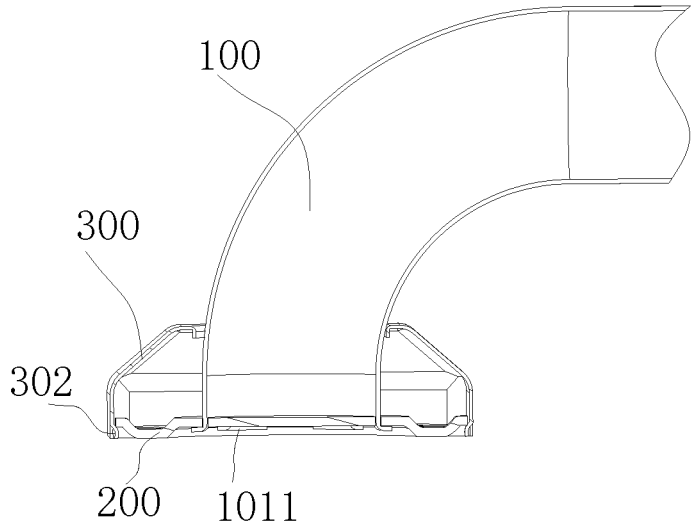
FIG. 7 depicts a local cross-sectional view of FIG. 6.

As shown in FIG. 6 and FIG. 7, a handrail 1 comprises a handrail body 100, two mounting plates 200 and two decorative covers 300.

A plurality of fixture blocks 101 are arranged at one end of the handrail body 100, and a plurality of notches 102 are formed by the fixture blocks 101 at each end jointly with the end face of the said handrail body 100.

The mounting plate 200 is preferred to be fixed on a wall, the mounting plate 200 has an outer side face facing the handrail body 100 and an inner side face facing the wall, a boss 201 is arranged on the mounting plate 200 protruding from the inner side face toward the outer side face, and a plurality of slots 202 penetrating through the inner side face and the outer side face are arranged on the boss 201, a plurality of fixture blocks 101 are inserted into a plurality of slots 202 and bent to form a plurality of first bending parts 1011, the first bending parts 1011 are firmly pressed against the inner side face of the boss 201, and a plurality of notches 102 are pressed against the outer side face. Wherein, a plurality of the first bending parts 1011 bend towards the edges of the boss 201.

The decorative cover 300 is arranged on the handrail body 100 and buckled with the mounting plate 200.

During installation, the decorative cover 300 is arranged on the handrail body 100, the fixture block 101 is inserted into the slot 202, the first bending parts 1011 bend towards the edges of the boss 201, then the mounting plate 200 is fixed on the wall; finally, the decorative cover 300 is buckled on the mounting plate 200.

Embodiment III

Figure 8:
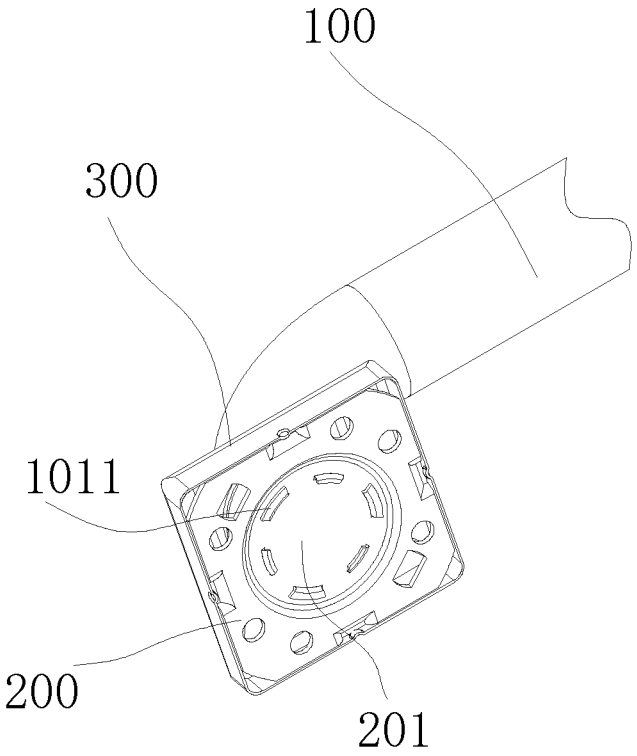
FIG. 8 depicts a schematic diagram of a handrail according to another embodiment of the present invention.
Figure 9:
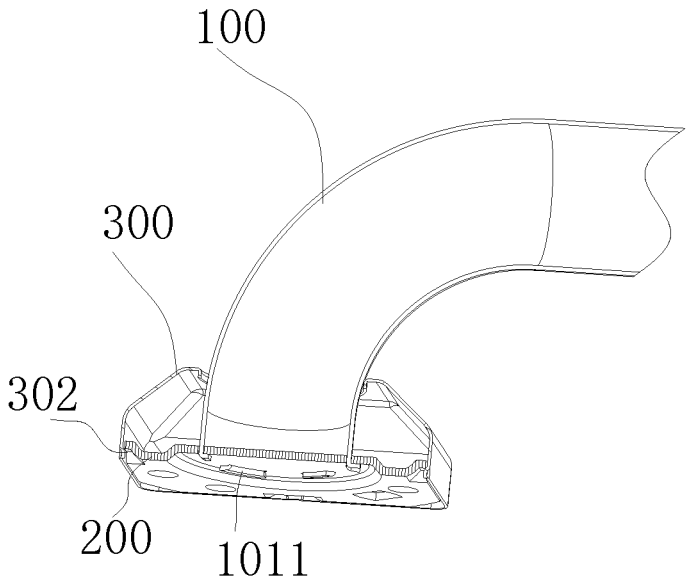
FIG. 9 depicts local cross-sectional view of FIG. 7.

As shown in FIG. 8 and FIG. 9, a handrail 1 comprises a handrail body 100, two mounting plates 200 and two decorative covers 300.

A plurality of fixture blocks 101 are arranged at one end of the handrail body 100, and a plurality of notches 102 are formed by the fixture blocks 101 at each end jointly with the end face of the said handrail body 100.

The mounting plate 200 is preferred to be fixed on a wall, the mounting plate 200 has an outer side face facing the handrail body 100 and an inner side face facing the wall, a boss 201 is arranged on the mounting plate 200 protruding from the inner side face toward the outer side face, and a plurality of slots 202 penetrating through the inner side face and the outer side face are arranged on the boss 201, a plurality of fixture blocks 101 are inserted into a plurality of slots 202 and bent to form a plurality of first bending parts 1011, the first bending parts 1011 are firmly pressed against the inner side face of the boss 201, and a plurality of notches 102 are connected to the outer side face. Wherein, a plurality of the first bending parts 1011 bend towards the center of the boss 201, and some of them bend towards the edges of the boss 201.

The decorative cover 300 is arranged on the handrail body 100 and buckled with the mounting plate 200.

During installation, the decorative cover 300 is first arranged on the handrail body 100, the fixture block 101 is inserted into the slot 202 and the first bending parts 1011 are bent or when the mounting plate 200 is fixed on the wall, the fixture block 101 is bent under the effect of wall, thus to make the decorative cover 300 buckled on the mounting plate 200.

In the description of the present invention, it should be understand that the terms "center", "longitudinal", "lateral", "length", "width", "thickness", "above", "below", "front", "rear", "left", "right", "vertical", "horizontal", "top", "bottom", "inner", "outer", "clockwise", and "counterclockwise" refer to the direction or position as shown in the attached drawings. The terms are provided only for the convenience of describing the present invention and simplifying the description, rather than indicating or implying that the device or element referred therein must have a specific direction, must be constructed or operated in a specific direction, they can not be construed as a limitation on the present invention.

In addition, the terms "first" and "second" are used for description purpose only, and cannot be construed as indicating or implying the relative importance or implicitly indicating the number of technical characteristics indicated therein. Therefore, the characteristics defined as "first" and "second" may explicitly or implicitly include one or more of the characteristics. In the description of the present invention, "a plurality of" means two or more, unless otherwise specifically defined.

In the present invention, unless otherwise clearly specified and defined, the terms including "install", "join", "connect", "fix" should be understood in a broad sense. For example, it can be a fixed connection or a removable connection or integration; it can be mechanical connection or electrical connection; it can be direct connection or indirect connection through a medium; it can be communication between two components or the interaction between two components. For ordinary technicians skilled in the art, the specific meaning of the above terms in the present invention can be understood according to the specific context.

In the present invention, unless clearly specified and defined otherwise, the first feature is "above" or "below" the second feature may include the direct contact of the first and the second features, or may include the contact between the first and the second features through any other feature, other than direct contact. Moreover, the first feature "above", "over" and "on" the second feature includes the first characteristic is directly above and obliquely above the second feature, or simply means that the level of the first feature is higher than that of the second feature. The first feature is "below", "under" and "underneath" the second feature includes that the first feature is directly below and obliquely below the second feature, or simply means that the level of the first feature is lower than that of the second feature.

In the description of specification, the description of reference terms, "an embodiment", "some embodiments", "examples", "specific examples", or "some examples" means the specific features, structure, material or characteristics described in combination with the embodiments or examples, which are included in at least one embodiment or example of the present invention. In the specification, the schematic expression of the above terms should not be construed as having to refer to the same embodiment or example. Further, the specific features, structures, materials, or characteristics described may be combined in any suitable manner in any one or more embodiments or examples. In addition, those skilled in the art may associate and combine different embodiments or examples described in the specification.

Although the embodiments of the present invention have been shown and described above, it can be understood that the said embodiments are exemplary and cannot be construed as limitations to the present invention. Ordinary technicians skilled in the art are allowed to make changes, modifications, substitutions, and variations to the said embodiments within the scope of the present invention.

What is claimed is:

1. A handrail comprising:

a handrail body, wherein at least one end of the handrail body is provided with a fixture block, and the fixture block and an end face of the handrail body jointly form a notch;

a mounting plate, wherein the mounting plate is fixed on a wall, the mounting plate has an outer side face facing the handrail body and an inner side face facing the wall, a boss is arranged on the mounting plate protruding from the inner side face toward an outer side face, and a slot penetrating through the inner side face and the outer side face is arranged on the boss, the fixture block is inserted into the slot and bent to form a first bending part, the first bending part is firmly pressed against an inner side face of the boss, and the notch is connected to the outer side face; and a plurality of fixture blocks, wherein the plurality of fixture blocks are arranged on the end face of the handrail body with a first circumferential interval, and the notch is formed jointly by two adjacent fixture blocks of the plurality of fixture blocks and the end face of the handrail body.

2. The handrail according to claim 1, wherein the handrail further comprises a plurality of slots, each of the plurality of slots are provided with the fixture block, and the notch is formed by the outer side face between two adjacent slots of the plurality of slots.

3. The handrail according to claim 1, wherein a mounting hole is arranged on the mounting plate penetrating through the inner side face and the outer side face, and the mounting hole is used to fix the mounting plate on the wall through a plurality of bolts.

4. The handrail according to claim 1, wherein the handrail further comprises a decorative cover, wherein the decorative cover is arranged on the handrail body and buckled with the mounting plate.

5. The handrail according to claim 4, wherein a bulge is arranged on an inner side wall of the decorative cover, a plurality of card slots are arranged at an edge of the mounting plate, the bulge is buckled in a card slot of the plurality of card slots so that the decorative cover is connected with the mounting plate.

6. The handrail according to claim 5, wherein the bulge is formed when an outer side wall of the decorative cover is raised towards the inner side wall; the plurality of card slots are formed when an inner side face of the mounting plate is raised towards the outer side face.

7. The handrail according to claim 5, wherein the handrail further comprises the plurality of card slots, and the plurality of card slots are arranged along the mounting plate with a second circumferential interval; there are a plurality of bulges, and the plurality of bulges are buckled in the plurality of card slots one by one correspondingly.

8. The handrail according to claim 1, wherein the first bending part bends toward a plurality of edges of the boss or/and a center of the boss.

9. The handrail according to claim 1, wherein the handrail body comprises two second bending parts and a straight rod part, a first end of the two second bending parts are connected to two ends of the straight rod part one by one correspondingly, the fixture block is arranged at a second end of both the two second bending parts; there are two mounting plates, and the two mounting plates are connected with the two second bending parts one by one correspondingly.

* * * * *